US010287659B2

(12) United States Patent
Zhong et al.

(10) Patent No.: US 10,287,659 B2
(45) Date of Patent: May 14, 2019

(54) HIGH-FORMABILITY AND SUPER-STRENGTH COLD-ROLLED STEEL SHEET

(71) Applicant: BAOSHAN IRON & STEEL CO., LTD., Shanghai (CN)

(72) Inventors: Yong Zhong, Shanghai (CN); Li Wang, Shanghai (CN); Weijun Feng, Shanghai (CN); Wei Xiong, Shanghai (CN); Jianjun Zhi, Shanghai (CN); Guangkui Hu, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 8 days.

(21) Appl. No.: 14/442,788

(22) PCT Filed: Feb. 21, 2013

(86) PCT No.: PCT/CN2013/071711

§ 371 (c)(1),
(2) Date: May 14, 2015

(87) PCT Pub. No.: WO2014/075404

PCT Pub. Date: May 22, 2014

(65) Prior Publication Data

US 2015/0337416 A1 Nov. 26, 2015

(30) Foreign Application Priority Data

Nov. 15, 2012 (CN) ..... 2012 1 0461631

(51) Int. Cl.

| | |
|---|---|
| ***C22C 38/06*** | (2006.01) |
| ***B21B 1/22*** | (2006.01) |
| ***C21D 8/02*** | (2006.01) |
| ***C21D 6/00*** | (2006.01) |
| ***C21D 1/26*** | (2006.01) |
| ***C21D 9/46*** | (2006.01) |
| ***C22C 38/00*** | (2006.01) |
| ***C21D 8/12*** | (2006.01) |
| ***C22C 38/02*** | (2006.01) |
| ***C22C 38/04*** | (2006.01) |

(52) U.S. Cl.

CPC ..... *C22C 38/06* (2013.01); *B21B 1/22* (2013.01); *C21D 1/26* (2013.01); *C21D 6/005* (2013.01); *C21D 6/008* (2013.01); *C21D 8/021* (2013.01); *C21D 8/0226* (2013.01); *C21D 8/0236* (2013.01); *C21D 8/0263* (2013.01); *C21D 8/0278* (2013.01); *C21D 8/1222* (2013.01); *C21D 8/1233* (2013.01); *C21D 8/1272* (2013.01); *C21D 9/46* (2013.01); *C22C 38/00* (2013.01); *C22C 38/001* (2013.01); *C22C 38/02* (2013.01); *C22C 38/04* (2013.01); *B21B 2001/225* (2013.01); *C21D 2211/005* (2013.01); *C21D 2211/008* (2013.01)

(58) Field of Classification Search

CPC ..... C22C 38/06; C22C 38/04; C22C 38/02

See application file for complete search history.

(56) References Cited

U.S. PATENT DOCUMENTS

| | | | |
|---|---|---|---|
| 2011/0198002 | A1 | 8/2011 | Nakagaito et al. |
| 2012/0175028 | A1 | 7/2012 | Matsuda et al. |
| 2013/0133792 | A1 | 5/2013 | Nakagaito et al. |

FOREIGN PATENT DOCUMENTS

| | | | |
|---|---|---|---|
| CN | 1343262 | A | 4/2002 |
| CN | 1415775 | A | 5/2003 |
| CN | 1811000 | A | 8/2006 |
| CN | 101263239 | A | 9/2008 |
| CN | 101724776 | A | 6/2010 |
| CN | 101939456 | A | 1/2011 |
| CN | 102471849 | A | 5/2012 |
| JP | S62182225 | A | 8/1987 |

(Continued)

OTHER PUBLICATIONS

European Patent Office, Supplementary European Search Report, EP13854271, dated Jul. 1, 2016.

The State Intellectual Property Office of People's Republic of China, Search Report, CN2012104616314, dated May 14, 2015.

The State Intellectual Property Office of People's Republic of China, Supplemental Search Report, CN2012104616314, Date Unknown.

(Continued)

*Primary Examiner* — Edward M Johnson

(74) *Attorney, Agent, or Firm* — Quarles & Brady LLP

(57) ABSTRACT

A high-formability and super-strength cold-rolled steel sheet and a manufacturing method thereof. The weight percentage of its components is: C 0.15-0.25%, Si 1.00-2.00%, Mn 1.50-3.00%, P≤0.015%, S≤0.012%, Al 0.03-0.06%, N≤0.008%, and the rest are Fe and inevitable impurities. The manufacturing method comprises the following steps: 1) smelting and casting; 2) heating to 1170~1230° C. and performing thermal insulation; 3) performing hot rolling, the finish rolling temperature being 880±30° C., and coiling at 550~650° C.; and 4) performing acid washing, cold rolling, and annealing, the cold rolling reduction being 40-60%, annealing at 860-920° C., and performing slow cooling to 690-750° C. with the cooling rate of 3~10° C./s; performing rapid cooling at 240~320° C., with the cooling speed ≥50° C./s, then heating to 360~460° C., and performing thermal insulation for 100~500 s to cool to the room temperature at last. Finally, a high-formability, low-rebound property and super-strength cold-rolled steel sheet with the yield strength of 600~900 MPa, the tensile strength of 980~1150 MPa, the elongation of 17~25% is obtained.

5 Claims, 1 Drawing Sheet

(56) References Cited

FOREIGN PATENT DOCUMENTS

| | | | |
|---|---|---|---|
| JP | S64-079322 | A | 3/1989 |
| JP | S64-184226 | A | 7/1989 |
| JP | H05179345 | A | 7/1993 |
| JP | H073332 | A | 1/1995 |
| JP | 2006-283130 | A | 10/2006 |
| JP | 2010-235988 | A | 10/2010 |
| JP | 2010275627 | A | 12/2010 |
| JP | 2011-184758 | A | 9/2011 |
| JP | 2012-012642 | A | 1/2012 |
| JP | 2012-041611 | A | 3/2012 |
| JP | 2014-034716 | A | 2/2014 |
| WO | WO 2011013845 | A1 * | 2/2011 |
| WO | 2011111332 | A1 | 9/2011 |
| WO | 2012020511 | A1 | 2/2012 |

OTHER PUBLICATIONS

Japanese Office Action (including English translation) issued in corresponding Japanese Patent Application No. JP2015-542138, 6 pages, dated Jan. 31, 2017.

English translation of Indonesian Office Action issued in corresponding Indonesian Patent Application No. P00201503196, 2 pages, dated Apr. 17, 2018, received from Indonesian associate on Jul. 20, 2018.

* cited by examiner

HIGH-FORMABILITY AND SUPER-STRENGTH COLD-ROLLED STEEL SHEET

CROSS-REFERENCE TO RELATED APPLICATIONS

This application represents the national stage entry of PCT International Application No. PCT/CN2013/071711 filed Feb. 21, 2013, which claims priority of Chinese Patent Application No. 201210461631.4 filed Nov. 15, 2012, the disclosures of which are incorporated by reference here in their entirety for all purposes.

TECHNICAL FIELD

The present invention relates to a cold-rolled steel plate, particularly to a high-formability, super-high-strength cold-rolled steel plate and a method for manufacturing the same, wherein the super-high-strength cold-rolled steel plate has a yield strength of 600-900 MPa, a tensile strength of 980-1150 MPa and an elongation of 17-25%, and has good plasticity and low resilience.

BACKGROUND ART

It is estimated that when the weight of a vehicle is decreased by 10%, its fuel consumption will be lowered by 5%-8%, and the emission of greenhouse gas $CO_2$ and such pollutants as $NO_x$, $SO_2$, etc., will be reduced as well. Self-owned brand passenger vehicles of our country are approximately 10% heavier than their foreign counterparts, and the difference in weight is even larger for commercial vehicles. Automobile steel plate, which is the main raw material of an automobile body, accounts for about 60-70% of the weight of the automobile body. Mass use of high-strength and super-high-strength steel plate with strength at the level of 590~1500 MPa instead of traditional automobile steel is an optimal solution to the problem of material in order to achieve "reduced weight, less energy consumption, higher safety and lower manufacturing cost" for automobiles, and it is also of great significance for the building of low-carbon society. Hence, it has been a trend in recent years for the development of steel plate to enhance the strength of the steel plate so that the thickness of the steel plate can be reduced. Development and application of advanced high-strength automobile steel mainly strengthened by phase change has been one of the mainstream subjects under research in various large steel companies in the world.

The high strength of traditional super-high-strength steel is originated from the high-strength phase structure of martensite, bainite, etc., but the plasticity and the formability are reduced significantly at the same time. Introduction of a certain amount of residual austenite into the structure of martensite or bainite is an effective technical approach to obtain materials with high-strength and high-plasticity. For example, TRIP steel is composed of ferrite, bainite and residual austenite, and has relatively high strength and plasticity, but this phase structure restricts the further improvement of its strength. Thus, replacement of bainite by martensite as the main strengthening phase has begun to gain attention.

Chinese Patent CN 102409235A discloses a high-strength cold-rolled transformation-induced plasticity steel plate and preparation method thereof, wherein the composition is: C: 0.1%-0.5%, Si: 0.1%-0.6%, Mn: 0.5%-2.5%, P: 0.02%-0.12%, S≤0.02%, Al: 0.02%-0.5%, N≤0.01%, Ni: 0.4%-0.6%, Cu: 0.1%-1.0%, and the balance of Fe. The preparation method comprises the following steps: (a) smelting molten steel meeting the composition condition, and casting into a blank; (b) rolling, wherein the heating temperature is 1100-1250° C., the heat preservation time is 1-4h, the initial rolling temperature is 1100° C., the end rolling temperature is 750-900° C., the coiling temperature is lower than 700° C., the thickness of a hot-rolled steel plate is 2-4 mm, and the cold-rolling accumulated reduction amount is 40-80%; and (c) continuous annealing, wherein the annealing temperature is 700-Ac3+50° C., the heat preservation time is 30-360 s, the cooling speed is 10-150° C./s, the aging temperature is 250-600° C., the aging time is 30-1200 s, and the steel plate is cooled to room temperature at a speed of 5-100° C./s. The steel plate of the invention has a yield strength of 380-1000 MPa, a tensile strength of 680-1280 MPa and an elongation of 15-30%. An elongation of about 20% can be realized by the invention on a tensile strength level of 1000 MPa, and the steel plate has relatively good comprehensive properties. However, a relatively large amount of alloy elements such as Cu, Ni and the like are added into the steel of the invention, which increases the material cost to a large extent, and notably restricts its application in the automobile field which has extremely critical demand on cost.

Japanese Patent JP 2005-232493 discloses the composition of a steel plate having high strength and high formability as well as a process. The composition comprises C: 0.02-0.25%, Si: 0.02-4.0%, Mn: 0.15-3.5%, and the balance of Fe. The structure of the material comprises double phases of ferrite and martensite, wherein the ferrite content accounts for 30-60%. The content of residual austenite is less than 1.0%. The coiling temperature of the hot-rolled plate is 500° C., and the plate is heated to 900-950° C. after cold rolling, followed by slow cooling to 640° C., then quick cooling to 350° C., and finally slow cooling to room temperature. Steel plate having about 850 MPa of yield strength, about 1000 MPa of tensile strength and 14% of elongation can be obtained via the above process. The steel of this invention features simple composition and low cost, but the elongation on the order of 14% still can not satisfy the demand of automobile high-strength steel on formability.

Chinese Patent CN200510023375.0 discloses a low-carbon, low-silicon cold-rolled transformation plasticity steel and a manufacturing method thereof. The components and weight percentages of the low-carbon, low-silicon cold-rolled transformation plasticity steel of this invention are: C 0.1-0.2%, Si 0.1-0.5%, Mn 0.5-2.0%, Al 0.5-1.5%, V 0.05-0.5%, trace amount of S, P, N, and the balance of Fe. After treatment, the low-carbon, low-silicon cold-rolled transformation plasticity steel exhibits good strong plasticity, 650-670 MPa of tensile strength and 32.5-34% of elongation. The steel of this invention has low tensile strength, and thus can not meet the demand of automobile super-high-strength steel on performance properties. Moreover, addition of a certain amount of Cr is required, rendering it unsuitable for use as automobile steel which has very critical demand on cost control.

SUMMARY

The object of the invention is to provide a high-formability, super-high-strength cold-rolled steel plate and a method for manufacturing the same, wherein the cold-rolled steel plate has a yield strength of 600-900 MPa, a tensile strength of above 980 MPa and an elongation of 17-25%, has good plasticity and low resilience, and is suitable for manufacturing structure parts and safety parts of vehicles.

In order to achieve the above object, the technical solution of the invention is as follows:

There are a number of existing methods for manufacturing high-strength steel. However, for the sake of ensuring the strength and formability of steel as required, a relatively large amount of alloy elements such as Cr, Nb, B and the like are added on the basis of existing components of carbon manganese steel according to most of these inventions, which not only adds to the production cost of steel products, but also degrades the manufacturability of the products, and increases the operation difficulty of smelting, continuous casting and other procedures. C, Si, Mn are the most cost-effective strengthening elements. It will be an extremely advantageous solution for the development of automobile high-strength steel to realize better comprehensive properties than those of existing automobile steel plate by comprehensive optimization design of composition- process- structure-properties.

The present invention employs a design starting from the composition of common carbon manganese steel, wherein the law of the influence of alloy elements such as Si, Mn, inter alia on the transformation behavior of the material is made full use of, and the final structure of the material is finely controlled by way of optimized quenching-partitioning technology, so as to achieve superior properties of integrated super high strength and high plasticity, and obtain super-high-strength steel plate products having excellent performance properties at low cost.

In particular, the high-formability, super-high-strength cold-rolled steel plate according to the present invention comprises the following components, based on weight percentages: C: 0.15-0.25%, Si: 1.00-2.00%, Mn: 1.50-3.00%, P≤0.015%, S≤0.012%, Al: 0.03-0.06%, N≤0.008%, and the balance of Fe and unavoidable impurities. The steel plate has a structure at room temperature of 10%-30% ferrite+60-80% martensite+5-15% residual austenite; a yield strength of 600-900 MPa, a tensile strength of 980-1150 MPa, and an elongation of 17-25%.

Preferably, in the composition of the steel plate, the content of C is 0.18-0.22%, based on weight percentage.

Preferably, in the composition of the steel plate, the content of Si is 1.4-1.8%, based on weight percentage.

Preferably, in the composition of the steel plate, the content of Mn is 1.8-2.3%, based on weight percentage.

Preferably, in the composition of the steel plate, P≤0.012%, S≤0.008%, based on weight percentage.

In the design of the chemical composition of the steel according to the invention:

C: It is the most basic strengthening element in steel, also a stabilizing element for austenite. Relatively high content of C in austenite is advantageous for increasing the fraction of residual austenite and improving the properties of the material. However, excessive C may exasperate the weldability of the steel products. Thus, the C content needs to be controlled in a suitable range.

Si: It is an element which inhibits the formation of carbides. Due to its extremely poor solubility in carbides, it can effectively inhibit or retard the formation of carbides, which, in the process of partitioning, facilitates the formation of carbon rich austenite that is retained as residual austenite to room temperature. However, excessive Si will degrade the high temperature plasticity of the material, and increase the defect occurrence in the process of smelting, continuous casting and hot rolling. Thus, the Si content also needs to be controlled in a suitable range.

Mn: It is a stabilizing element for austenite. The presence of Mn can lower the transformation temperature of martensite Ms and thus increase the content of residual austenite. In addition, Mn is a strengthening element for solid solution and favors the improvement of the strength of steel plate. However, excessive Mn may lead to unduly high hardenability of steel plate and go against the fine control over the structure of the material.

P: It has a function similar to Si. It mainly acts to strengthen solid solution, inhibit formation of carbides, and enhance the stability of residual austenite. The addition of P may deteriorate weldability significantly, and increase the brittlement of the material. In the present invention, P, which is considered as an impurity element, is controlled at a minimized level.

S: As an impurity element, its content is controlled at a level as low as possible.

Al: It has a function similar to Si. It mainly acts to strengthen solid solution, inhibit formation of carbides, and enhance the stability of residual austenite. However, the strengthening effect of Al is weaker than that of Si.

N: It is not an element in need of special control. N is controlled at a minimized level during smelting so as to decrease its undesirable impact on the control over inclusions.

There is provided a method for manufacturing a high-formability, super-high-strength cold-rolled steel plate, comprising:

1) smelting, casting the above composition is smelted and cast into a plate blank;

2) the plate blank is heated to 1170-1230° C. and held;

3) hot rolling the end rolling temperature is 880±30° C., and the coiling temperature is 550-650° C.;

4) acid washing, cold rolling cold rolling reduction rate is 40-60%, and steel strip is formed;

5) annealing cold rolling reduction rate is 40-60%. The steel strip is annealed at 860-920° C., and slowly cooled to 690-750° C. at a cooling speed of 3-10° C./s so that a certain proportion of ferrite is generated in the material. Then, it is rapidly cooled to 240-320° C. at a cooling speed≥50° C./s so that austenite is partially transformed into martensite. Then, it is reheated to 360-460° C., and held for 100-500 s. Finally, it is cooled to room temperature;

in the end, a super-high-strength cold-rolled steel plate having a yield strength of 600-900 MPa, a tensile strength of 980-1150 MPa, an elongation of 17-25%, superior formability and low resilience is obtained.

Preferably, the plate blank is heated to 1170-1200° C. in step 2).

Preferably, the coiling temperature for the hot rolling is 550-600° C. in step 3).

Preferably, the annealing temperature is 860-890° C. in step 5).

Preferably, the annealing is carried out in a continuous mode and is controlled by means of irradiation heating in a reducing atmosphere, wherein the content of H in the furnace is 10-15% in step 5).

Preferably, the steel strip is slowly cooled to 700-730° C. in step 5).

Preferably, the steel strip is rapidly cooled to 280-320° C. in step 5).

Preferably, rapid cooling is followed by reheating to 390-420° C. and holding for 180-250 s in step 5).

Preferably, the holding time for annealing at 860-920° C. is 80-120 s in step 5).

Preferably, the cooling speed for rapid cooling to 240-320° C. is 50-100° C./s in step 5).

Preferably, the speed for reheating to 360-460° C. after rapid cooling is 5-10° C./s in step 5).

In the present invention, a high temperature heating furnace for hot rolling is used to hold temperature so as to facilitate full dissolution of C and N compounds, and coiling is performed at lower coiling temperature so as to obtain fine precipitate.

A conventional acid washing and cold rolling process is used. The annealing process is carried out in a continuous mode at relatively high temperature so that a homogenized austenite structure is formed and improvement of steel strength is favored. Then, the steel strip is slowly cooled to 690-750° C. at a cooling speed of less than 10° C./s, so as to obtain a certain amount of ferrite which helps increasing steel plasticity. Then, the steel strip is rapidly cooled to a temperature between $M_s$ and $M_f$, so that austenite is partially transformed into martensite which helps increase steel strength. Subsequently, the steel strip is reheated to 360-460° C. and held for 100-300 s, resulting in redistribution of carbon between martensite and austenite as well as formation of carbon rich austenite having high stability, so that there is obtained in the final structure a certain amount of residual austenite which is advantageous for the improvement of work hardening capacity and formability. The final structure of the steel plate is composed of ferrite+martensite+residual austenite. Owing to the high Si content used in the design, martensite that has already been formed in the steel substantially undergoes no decomposition in the course of partitioning, such that final acquisition of the desired structure form is guaranteed.

After the above treatment, the steel of the invention may obtain a yield strength of 600-900 MPa, a tensile strength of 980-1150 MPa, and an elongation of 17-25%.

Additionally, due to the decreased C content in martensite after partitioning, the anelasticity of martensite during cold deformation is reduced, and the resilience of the invention steel is thus improved remarkably.

Comparison between the present invention and the prior art:

The high-strength, continuously annealed, cold-rolled transformation-induced plasticity steel plate disclosed by Chinese Patent CN201010291498.3 may achieve an elongation of about 20% at a tensile strength level of 1000 MPa, and has good comprehensive properties. However, a relatively large amount of alloy elements such as Cu, Ni, Cr and the like are added into the steel of this invention, which increases the material cost to a large extent, and notably restricts its application in the automobile field which has extremely critical demand on cost.

Japanese Patent JP 2005-232493 discloses a high-strength, high-formability cold-rolled steel plate that has simple composition and low cost, but the elongation on the order of 14% still can not satisfy the demand of automobile high-strength steel on formability.

U.S. Pat. No. 6,210,496 discloses a high-strength, high-formability cold-rolled steel that has relatively low tensile strength and thus can not meet the demand on the performance properties of automobile super-high-strength steel. Moreover, addition of a certain amount of Cr is required, rendering it unsuitable for use as automobile steel which has very critical demand on cost control.

Beneficial Effects of the Present Invention:

By designing the composition suitably according to the present invention, super-high-strength cold-rolled steel plate is produced using continuous annealing under conventional hot rolling and cold rolling process conditions, without addition of any expensive alloy element. The strength can be significantly increased simply by a combination of suitably increased Mn content and the particular continuous annealing process, and the good plasticity is still preserved. Meanwhile, no special production equipments are needed, and the production cost is kept low.

After smelting, hot rolling, cold rolling, annealing and tempering rolling, the steel of the present invention has a good prospect of application in safety and structure parts for automobile, and is particularly suitable for manufacture of vehicle structure parts and safety parts that have complicated shapes and high demand on formability, such as side door bars, bumper bars, B pillars, etc.

DETAILED DESCRIPTION

Figure 1:
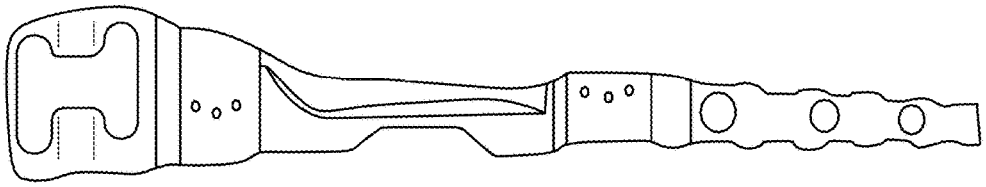
FIG. 1 shows a B pillar made from the steel of the present invention (thickness: 2.0 mm).

The invention will be further illustrated with reference to the following examples.

Table 1 lists the chemical compositions of the examples of the steel according to the present invention. After smelting, hot rolling, cold rolling, annealing and tempering rolling, the products were obtained. The annealing process parameters as well as the mechanical properties of the products are shown in Table 2. As indicated by Table 2, a super-high-strength cold-rolled steel plate having a yield strength of 600-900 MPa, a tensile strength of 980-1150 MPa, and an elongation of 17-25% has been obtained according to the present invention by suitable process coordination.

TABLE 1

Unit: wt %

| | C | Si | Mn | Cr | Cu | Ni | P | S | Al | N |
|---|---|---|---|---|---|---|---|---|---|---|
| Ex. 1 | 0.22 | 1.8 | 2.1 | — | — | — | 0.005 | 0.004 | 0.042 | 0.0032 |
| Ex. 2 | 0.15 | 2.0 | 1.5 | — | — | — | 0.010 | 0.012 | 0.030 | 0.0051 |
| Ex. 3 | 0.20 | 1.3 | 3.0 | — | — | — | 0.008 | 0.005 | 0.050 | 0.0068 |
| Ex. 4 | 0.18 | 1.6 | 2.7 | — | — | — | 0.007 | 0.007 | 0.060 | 0.0046 |
| Ex. 5 | 0.25 | 1.0 | 2.3 | — | — | — | 0.012 | 0.006 | 0.050 | 0.0077 |
| Ex. 6 | 0.21 | 1.4 | 1.9 | — | — | — | 0.015 | 0.008 | 0.040 | 0.0039 |
| Comp. Ex. 1 | 0.35 | 0.52 | 1.50 | 0.3 | 0.5 | 0.3 | 0.05 | 0.001 | 0.035 | 0.0020 |

TABLE 1-continued

| | C | Si | Mn | Cr | Cu | Ni | P | S | Al | N |
|---|---|---|---|---|---|---|---|---|---|---|
| | | | | | | | | | | Unit: wt % |
| Comp. Ex. 2 | 0.17 | 1.35 | 2.00 | — | — | — | 0.015 | 0.001 | 0.040 | 0.0025 |
| Comp. Ex. 3 | 0.21 | 1.05 | 2.02 | 0.33 | — | — | 0.041 | — | 0.051 | — |

TABLE 2

| | | Annealing process | | | | | | | | | Mechanical properties | | |
|---|---|---|---|---|---|---|---|---|---|---|---|---|---|
| | Process number | Annealing temperature ° C. | Holding times | Slow cooling speed ° C./s | Initial temperature for rapid cooling ° C. | Rapid cooling speed ° C./s | End temperature for rapid cooling ° C. | Reheating speed ° C./s | Reheating temperature ° C. | Holding time for reheating S | YS (MPa) | TS (MPa) | TEL (%) |
| Ex. 1 | i | 880 | 80 | 4 | 700 | 60 | 320 | 5 | 460 | 180 | 680 | 996 | 21.8 |
| | ii | 880 | 100 | 4 | 720 | 60 | 300 | 5 | 460 | 220 | 700 | 998 | 18.3 |
| | iii | 880 | 110 | 6 | 720 | 80 | 300 | 5 | 390 | 260 | 750 | 1085 | 17.3 |
| Ex. 2 | i | 900 | 90 | 6 | 750 | 80 | 280 | 10 | 390 | 150 | 687 | 982 | 23.5 |
| | ii | 900 | 100 | 6 | 730 | 80 | 240 | 10 | 360 | 240 | 667 | 986 | 22.0 |
| | iii | 920 | 120 | 8 | 750 | 100 | 240 | 10 | 360 | 100 | 710 | 1016 | 18.1 |
| Ex. 3 | i | 860 | 120 | 8 | 710 | 50 | 290 | 8 | 430 | 280 | 822 | 1134 | 17.1 |
| | ii | 860 | 100 | 8 | 690 | 50 | 290 | 8 | 430 | 230 | 780 | 1105 | 19.0 |
| | iii | 860 | 90 | 10 | 690 | 70 | 300 | 8 | 460 | 250 | 715 | 1070 | 20.2 |
| Ex. 4 | i | 860 | 90 | 3 | 700 | 90 | 260 | 5 | 420 | 140 | 810 | 1098 | 20.1 |
| | ii | 880 | 90 | 3 | 700 | 90 | 250 | 7 | 420 | 280 | 697 | 1057 | 21.6 |
| | iii | 860 | 90 | 5 | 700 | 100 | 260 | 9 | 460 | 300 | 776 | 1106 | 20.9 |
| Ex. 5 | i | 890 | 80 | 5 | 730 | 60 | 270 | 6 | 400 | 190 | 756 | 1048 | 24.3 |
| | ii | 880 | 100 | 5 | 740 | 70 | 280 | 8 | 380 | 220 | 805 | 1101 | 22.1 |
| | iii | 890 | 120 | 7 | 730 | 80 | 310 | 10 | 410 | 210 | 877 | 1102 | 20.8 |
| Ex. 6 | i | 870 | 80 | 7 | 720 | 90 | 300 | 8 | 400 | 240 | 736 | 1029 | 20.3 |
| | ii | 900 | 90 | 7 | 720 | 70 | 280 | 8 | 390 | 200 | 775 | 1055 | 19.1 |
| | iii | 920 | 120 | 9 | 720 | 50 | 260 | 8 | 360 | 180 | 877 | 1102 | 17.8 |
| Comp. Ex. 1 | | 830 | — | — | — | — | 420 | — | 420 | 500 | 774 | 1011 | 21 |
| Comp. Ex. 2 | | 900 | — | — | 640 | — | 350 | — | — | — | 848 | 1010 | 14 |
| Comp. Ex. 3 | | 800 | — | — | 635 | — | 410 | — | 410 | 180 | 492 | 704 | 38 |

The steel of the invention is particularly suitable for the manufacture of vehicle structure parts and safety parts that have complicated shapes and high demand on formability, such as side door bars, bumper bars, B pillars, etc.

Figure 2:
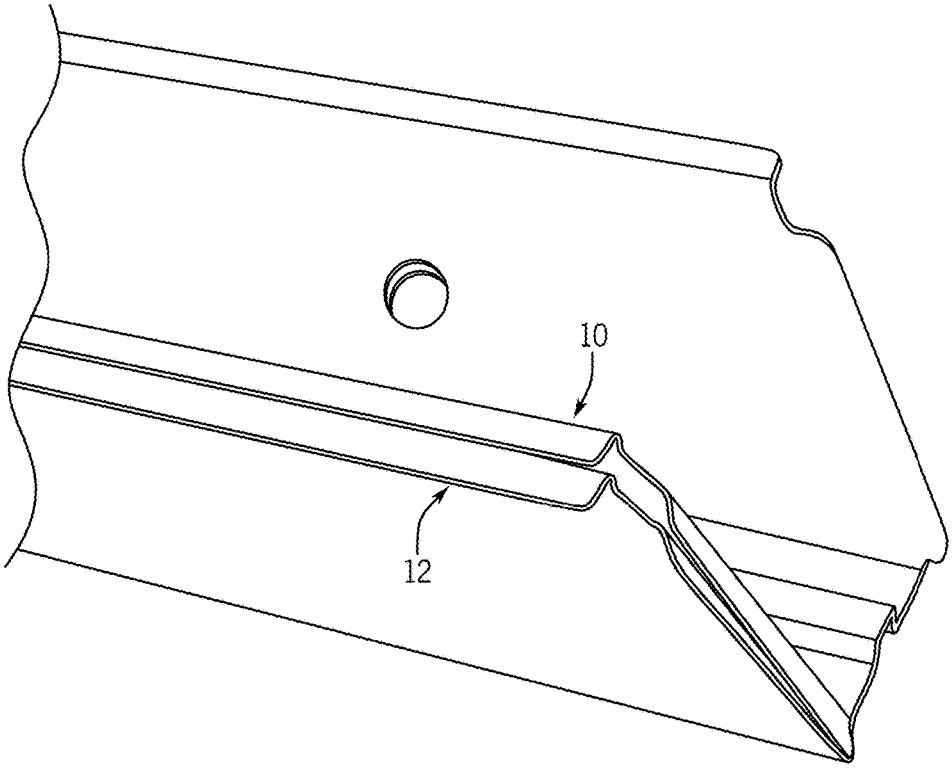
FIG. 2 shows the comparison of resilience between the steel of the present invention and commercial dual-phase steel at 980 MPa level (DP980) (thickness: 1.2 mm for both).

Turn to FIGS. 1 and 2. FIG. 1 shows a B pillar made from the steel of the invention (thickness: 2.0 mm). As indicated by FIG. 1, the steel of the invention exhibits excellent formability.

FIG. 2 shows the comparison of resilience between the steel of the invention 10 and commercial dual-phase steel 12 at 980 MPa level (DP980) (thickness: 1.2 mm for both). It demonstrates that the resilience of the steel of the invention 10 is obviously lower than that of DP980 12 under the same forming process.

We claim:

1. A high-formability and ultra-high-strength steel plate, comprising:

a) 0.15-0.25 wt % carbon (C)

b) 1.00-2.00 wt % silicon (Si)

c) 1.50-3.00 wt % manganese (Mn)

d) ≤0.015 wt % phosphorus (P)

e) ≤0.012 wt % sulfur (S)

f) 0.03-0.06 wt % aluminum (Al)

g) ≤0.008 wt % nitrogen (N)

h) a balance of iron (Fe) and unavoidable impurities;

wherein the steel plate structure at room temperature consists of 10%-30% ferrite, 60-80% martensite, and 5-15% residual austenite;

wherein the steel plate exhibits a yield strength of 600-900 MPa, a tensile strength of 980-1150 MPa, and an elongation of 17-25%, wherein the high-formability and ultra-high-strength steel plate is prepared by a method comprising the following steps:

a) smelting raw materials according to the composition of the high-formability and ultra-high-strength steel plate;

b)casting the raw materials into a plate blank;

c) heating the casted plate blank of step b) to 1170-1230° C. and holding the temperature;

d) hot rolling the casted plate blank of step c) at an end rolling temperature of 880±+° C. and at a coiling temperature of 550-650° C.;

e) acid washing the coiled steel of step d);

f) cold rolling the acid washed steel of step e) to a cold rolling reduction rate of 40-60% until a steel strip is formed;

g) continuously annealing the steel strip of step f) by steps (1) to (5):

(1) annealing the steel strip at an annealing temperature of 860-920° C.;

(2) cooling the steel strip to 690-750° C. at a cooling speed of 3-10° C./s so that a certain proportion of ferrite is generated in the steel strip;

(3) cooling the steel strip to 240-320° C. at a cooling speed ≥50° C./s so that the austenite is partially transformed into martensite;

(4) reheating the steel strip to 360-460° C., and holding that temperature for 100-500s;

(5) cooling the steel strip to room temperature.

2. The high-formability and ultra-high-strength steel plate of claim 1, wherein carbon is present in an amount ranging from 0.18-0.22 wt %.

3. The high-formability and ultra-high-strength steel plate of claim 1, wherein silicon is present in an amount ranging from 1.4-1.8 wt %.

4. The high-formability and ultra-high-strength steel plate of claim 1, wherein manganese is present in an amount ranging from 1.8-2.3 wt %.

5. The high-formability and ultra-high-strength steel plate of claim 1, wherein phosphorus is present in an amount ≤0.012 wt % and sulfur is present in an amount ≤0.008 wt %.

* * * * *